United States Patent [19]

Hanson

[11] 4,314,411

[45] Feb. 9, 1982

[54] REMOVABLE, ADJUSTABLE, FOOT-SUPPORTING AND FOOT-POSITIONING, ORTHOPEDIC INSERTS FOR USE IN ATHLETIC FOOTWEAR

[75] Inventor: Chris A. Hanson, Boulder, Colo.

[73] Assignee: Hanson Industries Incorporated, Boulder, Colo.

[21] Appl. No.: 130,200

[22] Filed: Mar. 13, 1980

[51] Int. Cl.[3] ..... A43B 7/14; A43B 5/04

[52] U.S. Cl. ..... 36/81; 36/91; 36/117

[58] Field of Search ..... 36/81, 91, 43, 117–120; 128/596, 597, 598

[56] References Cited

U.S. PATENT DOCUMENTS 1,633,413 6/1927 La Marca ..... 36/91

1,924,792 8/1933 Kay ..... 128/596

2,075,942 4/1937 Howell ..... 128/597 X 2,183,197 12/1939 Kohlruss ..... 128/598

3,922,800 12/1975 Miller et al. ..... 36/117

FOREIGN PATENT DOCUMENTS 500743 6/1930 Fed. Rep. of Germany ..... 128/596

*Primary Examiner*—James Kee Chi

*Attorney, Agent, or Firm*—Merriam, Marshall & Bicknell

[57] ABSTRACT

Removable, adjustable, foot-supporting and foot-positioning, orthopedic inserts for selectively and correctly supporting and positioning bottom regions of the foot, which are constructed and designed for use in athletic or sports footwear, including shoes and boots, whereby the foot is selectively and correctly supported and positioned in the footwear, and the leg, in turn, is selectively and correctly supported and positioned relative to the footwear.

13 Claims, 6 Drawing Figures

FIG. 1
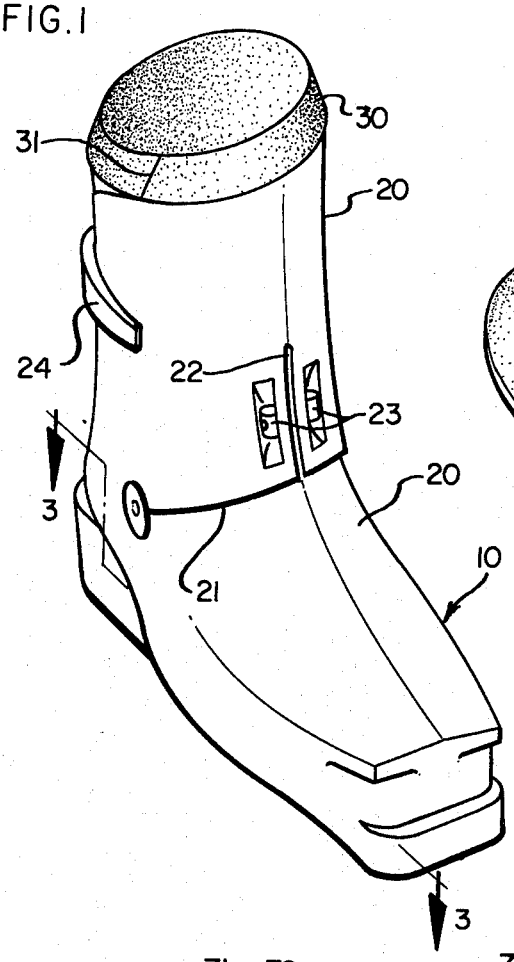
FIG. 2
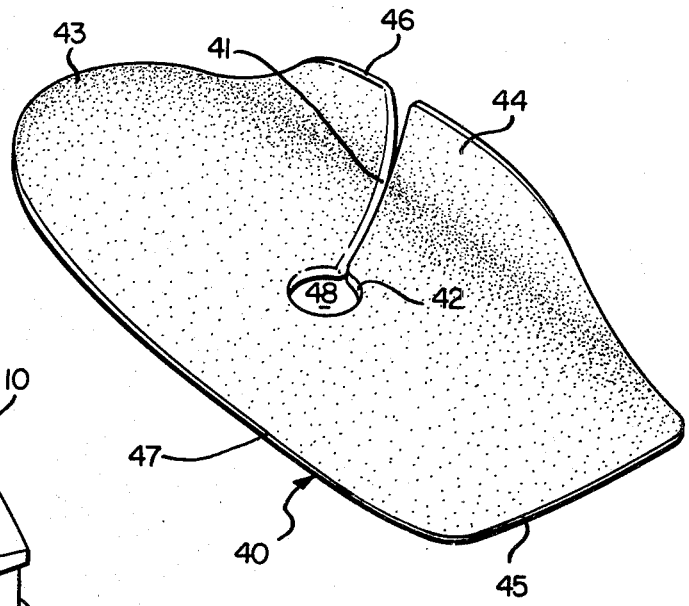
FIG. 3
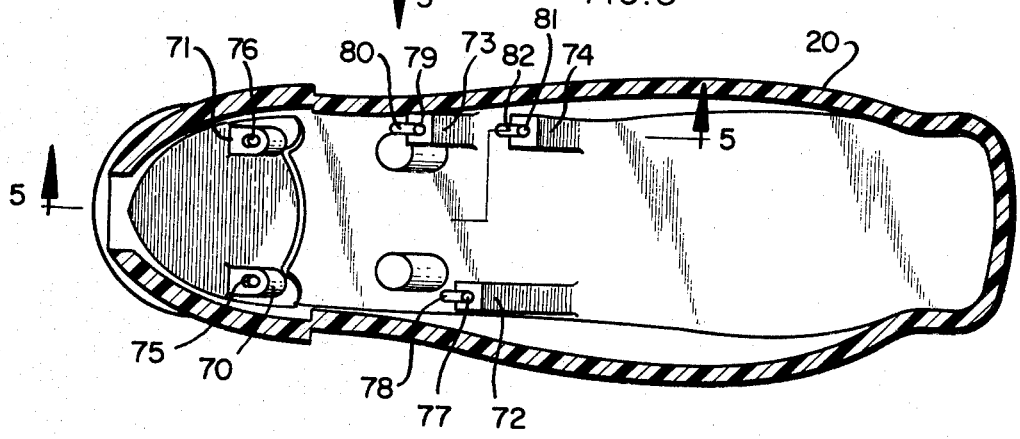
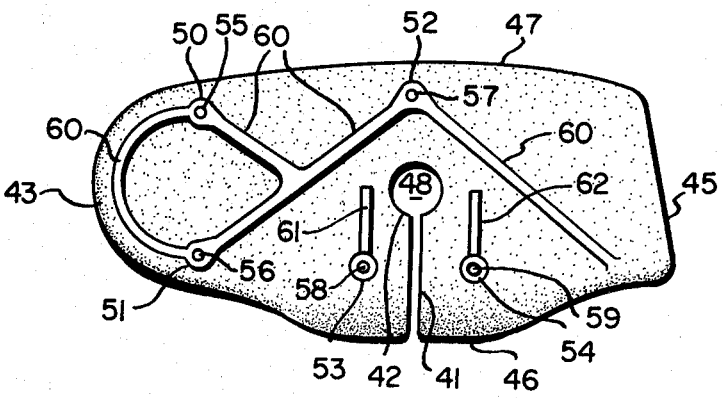
FIG. 4

REMOVABLE, ADJUSTABLE, FOOT-SUPPORTING AND FOOT-POSITIONING, ORTHOPEDIC INSERTS FOR USE IN ATHLETIC FOOTWEAR

The present invention relates to removable, adjustable, orthopedic, foot-supporting and foot-positioning inserts for selectively supporting and positioning bottom regions of the foot, including the arch, rearward of the toes, or, for example, rearward of the ball of the foot. More particularly, the removable, adjustable, orthopedic, foot-supporting and foot-positioning inserts are constructed and designed for use in a wide variety of kinds and types of athletic or sports footwear, including shoes (e.g., so-called low-top shoes) and ankle-covering boots (e.g., ski boots, ice skates, mountain-climbing boots, etc.).

The removable, adjustable, foot-supporting and foot-positioning, orthopedic inserts are constructed and designed to provide adjustable, selective, proper, comfortable, ready and custom-fitting of the particular foot of the wearer relative to the floor of the footwear, so as to selectively and correctly support and position the foot, including the arch, within athletic or sports footwear (e.g., shoes and boots) for intended purposes, which supporting and positioning of the foot, in turn, selectively and correctly support and position the leg relative to the footwear. The inserts follow or accommodate the contour of the foot and thus "copes" the foot. Consequently, such inserts provide adjustable, selective, proper, comfortable, ready and custom fitting of the foot in footwear for the purposes or activities desired or needed by the wearer.

The removable, adjustable inserts may support (and position) the entire bottom of the foot, including the arch, rearward or exclusive of the toes. That is, the inserts may support the foot from the plantar surface of the metatarsus through the plantar surface of the lesser tarsus to the posterior plantar surface of the rear foot.

The particular illustrative removable, adjustable, foot-supporting and foot-positioning, orthopedic insert shown in the accompanying drawings and herein described with respect thereto, supports (and positions) the bottom of the foot rearward of the vicinity of the ball of the foot. Stated differently, it supports the bottom of the foot, including the arch, to or approaching the vicinity of the ball of the foot. More particularly, it supports bottom regions of the foot from the posterior plantar surface of the metatarsus through the plantar surface of the lesser tarsus to the posterior plantar surface of the rear foot.

My removable, adjustable, foot-supporting and foot-positioning, orthopedic inserts are in the nature of comfortable, contoured, foot-conforming platforms for the feet and are designed and shaped to conform to the actual and/or desired contour of the feet. The inserts are securely but removably positioned to or near the floor of the footwear by insert-supporting platform structure operatively associated with the floor, to or with which the inserts are operatively and selectively connectable.

If desired, my removable, adjustable, foot-supporting and foot-positioning, orthopedic inserts may be used, for example, in rear-entry ski boots (see U.S. Pat. Nos. 3,798,799, 3,882,561 and 4,083,127, the disclosures of which are hereby expressly incorporated by reference herein), including the new and improved rear-entry plastic ski boots having one-piece, split, wrap-around, substantially rigid outer shells and inner, flexible liner members, shown and described herein, as well as conventional front-entry and side-entry ski boots, ice skates, or shoes or boots used for a variety of athletic or sports purposes.

In the accompanying illustrative diagrammatic drawings:

FIG. 1 is a perspective view of an assembled, plastic ski boot having a substantially rigid (semi-rigid), one-piece, split outer shell of a wrap-around construction, and a removable, flexible, one-piece, split liner member. A removable, adjustable, foot-supporting and foot-positioning, orthopedic insert is positioned and retained at the floor of the boot between the outer, substantially rigid shell and the inner, flexible liner member, but is not shown in FIG. 1;

FIG. 2 is a perspective, upper view of the removable, adjustable, orthopedic, foot-supporting and foot-positioning insert removed from the ski boot of FIG. 1;

FIG. 3 is a sectional view taken along the line 3—3 of FIG. 1, but with the removable, flexible liner member and the removable, adjustable, orthopedic, foot-supporting and foot-positioning insert shown in FIG. 2 removed;

FIG. 4 is a bottom view of the removable, adjustable, orthopedic, foot-supporting and foot-adjusting insert shown in FIG. 2;

Figure 6:
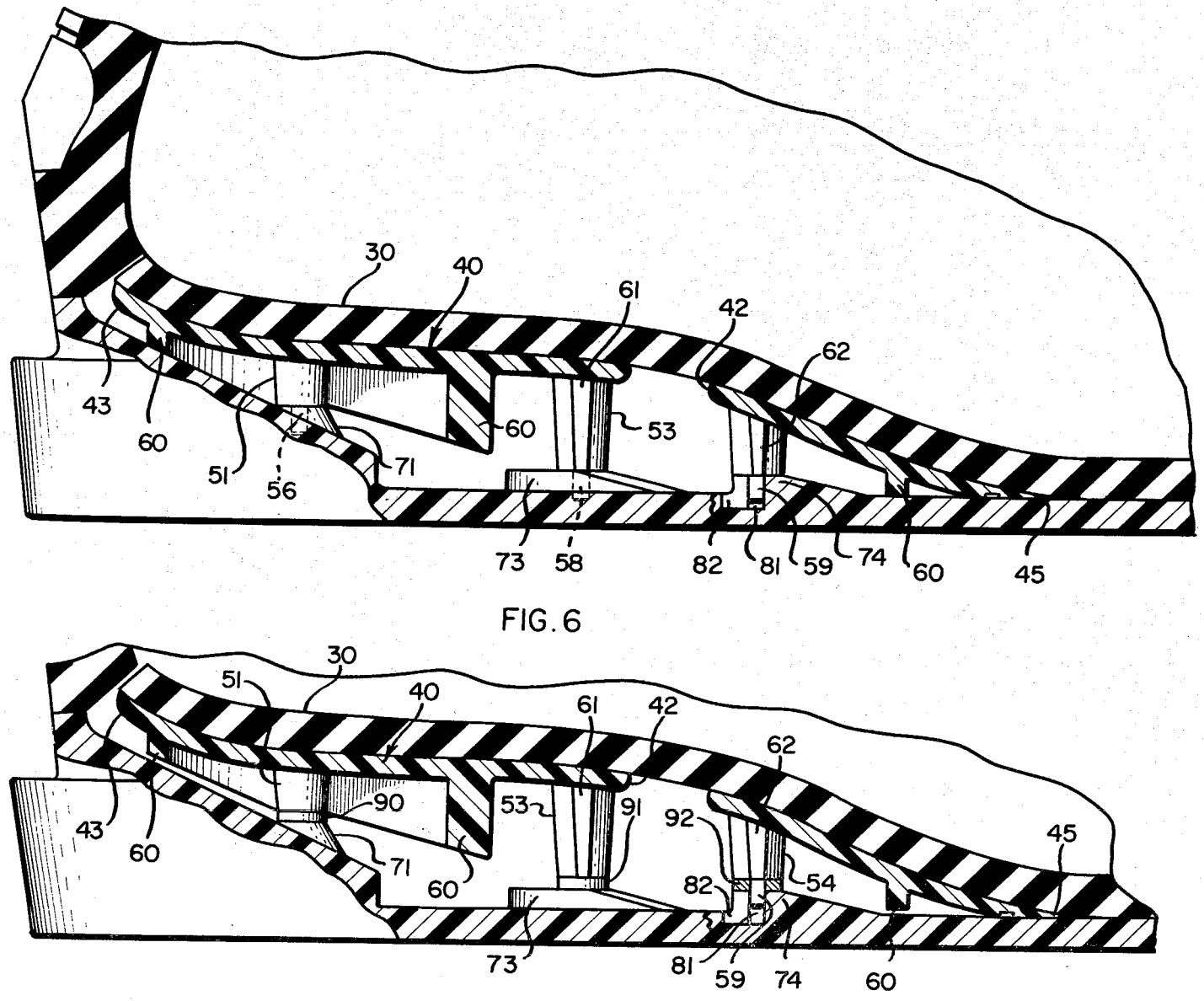

FIG. 5 is an enlarged, fragmentary, sectional view taken along the line 5—5 of FIG. 3, but with the removable, flexible liner member and removable, adjustable, orthopedic, foot-supporting and foot-positioning insert operatively positioned and secured in the ski boot of FIG. 1; and, FIG. 6 is an enlarged, fragmentary, sectional view, similar to FIG. 5, but showing removable annular spacers selectively inserted onto at least some of the bottom pegs of the removable, adjustable, orthopedic, foot-supporting and foot-positioning insert, so as to selectively and adjustably support and position the insert and foot relative to the floor of the ski boot.

It should be understood that when my removable, adjustable, foot-supporting and foot-positioning, orthopedic inserts are used in conjunction with boots, including ski boots and the particular improved, one-piece, split, wrap-around, plastic ski boots shown and described herein, one may effectively include the use of removable, deformable, pressure-compensating fitting pads having viscous, flowable, stable, substantially homogeneous, pressure-compensating fitting material retained in a sealed, flexible, resilient, protective envelope enclosure formed, for example, of a thermoplastic, synthetic resinous film. The pressure-compensating pad may be positioned between the flexible liner member and shell, and, for example, fitted over the instep and around the ankle, as desired or needed.

The viscous, flowable, fitting material of the pressure-compensating pad, for example, may comprise a viscous, flowable, semi-solid, non-resilient, continuous phase formed of the combination of wax, which is an essentially non-flowable solid, and liquid oil, and a discontinuous phase of discrete, light-weight, sturdy microbeads substantially uniformly distributed throughout the continuous phase, such as expanded, monocellular microspheres of thermoplastic, resilient resinous material (see U.S. Pat. No. 3,615,972 to Morehouse et al.) formed, for example, of vinylidene chloride-acrylonitrile copolymer. Such flowable fitting materials are disclosed in U.S. Pat. Nos. 4,038,762 and 4,108,928 to Jack C. Swan, Jr. and U.S. patent application Ser. No. 939,400, filed Sept. 5, 1978, of Jack C. Swan, Jr.

If desired, the microbeads which are distributed throughout the continuous wax-oil phase may be unicellular particles in the form of hollow, glass microbeads, such as disclosed in U.S. Pat. No. 4,144,658 to Jack C. Swan, Jr., and U.S. patent application Ser. No. 882,644, filed Mar. 2, 1978, of Jack C. Swan, Jr., and U.S. patent application Ser. No. 91,955, filed Nov. 7, 1979, of Jack C. Swan, Jr.

The disclosures of said above-identified U.S. patent application Ser. Nos. 939,400, 882,644 and 91,955, and said U.S. Pat. Nos. 4,038,762, 4,108,928 and 4,144,658 of Jack C. Swan, Jr. are hereby expressly incorporated by reference herein. Also, see U.S. Pat. No. 4,083,127 to Chris A. Hanson, which discloses adjustable, pressure-compensating, custom fitting pads having a predetermined amount of fitting material, and their use in boots.

Referring to FIG. 1, the rear-entry ski boot 10 illustrated therein has a substantially rigid (semi-rigid), one-piece, rear-entry, plastic outer shell 20. The shell 20 has a split, wrap-around construction and may be formed, for example, of synthetic resinous material such as polyurethane. The instep region of the shell includes means for selectively adjusting and controlling the boot flexure and includes a slip joint arrangement 21, a split portion 22, and adjustable flexure means 23. Closure means 24 are, in part, shown and enable one to selectively open and close the shell 20 of the ski boot 10. The one-piece, removable, rear-entry liner member 30 is substantially flexible, may be formed of plastic foam, such as polyurethene foam, and has a split construction (see 31). Both the shell 20 and liner 30 are split from the top of the boot (the cuff region) to the heel region of the boot, so as to provide for the ready entry of the foot from the rear of the ski boot 10.

FIG. 2 is an upper, perspective view showing my removable, adjustable, orthopedic, foot-supporting and foot-positioning insert 40 removed from the ski boot 10 shown in FIG. 1. That particular insert embodiment 40 supports (and positions) the bottom of the foot (including the arch) rearward of the vicinity of the ball of the foot. More particularly, it supports (and positions) bottom regions of the foot from the posterior plantar surface of the metatarsus through the plantar surface of the lesser tarsus to the posterior plantar surface of the rear foot.

When the insert 40 is placed in position in the boot 10, it may be adjusted and positioned, within varied but controlled limits relative to the floor of the boot, to selectively and correctly support and position the foot (including the arch) within the boot, thereby accommodating and correcting variations in the structure of the foot and the distinctive orthopedic configuration of the foot of the particular wearer. Accordingly, the leg, in turn, of the wearer, in turn, is selectively and correctly supported and positioned relative to the boot. The adjustable or selective supporting and positioning of the foot and, in turn, the leg of the wearer, facilitates or provides for the proper and desired positioning and movement of the feet and legs during skiing and consequently the transmittal of the proper and desired action (and control) to the skis.

The insert 40 shown in FIG. 2 should be of sturdy, one-piece, semi-flexible construction. It may be conveniently molded of synthetic resinous material, such as polyurethane. It may have, for example, a nominal thickness (excluding the bottom support posts, pegs and strength-enhancing ribbing described later) of about $\frac{1}{8}$ inch, and that thickness tapers or feathers near, towards and at its peripheral edges. For example, the peripheral edge of the heel portion 43, the inner side edge 46, the outer side edge 47, and the front edge 45 are tapered or feathered toward the peripheral edge of the insert 40. The peripheral side and rear edges of the insert are contoured to fit the bottom of the foot and are upturned to provide a lip so as to provide or accommodate the contour of the bottom of the foot.

The contoured arched region 44, which supports and positions the arch of the foot, has a flexure slot or flexure slit 41 which transversely extends from the inner side edge of the insert 40 to a connecting, enlarged, circular, stress-distributing inner edge or portion 42, which, in turn, defines a key hole or opening 48 positioned intermediate the opposed side edges 46 and 47 of the insert 40. The slit 41 may be about $\frac{1}{4}$ inch or more wide near its mouth or inner peripheral side edge 46 of the insert 40, and the width of the slit may taper inwardly towards the hole 48 to provide a width of about $\frac{1}{8}$ inch as it approaches the vicinity of the enlarged circular opening or hole 48. The flexure slit 41 facilitates the flexing of the insert, and the circular, stress-distributing edge 42 distributes the shear forces or stresses developed during flexing over an enlarged region, thereby obviating cracking or breaking of the insert at the inner, terminating end of the slit 41.

FIG. 4 is a bottom view of the removable, adjustable, foot-supporting and foot-positioning, orthopedic insert 40 shown in FIG. 2, and shows supporting or strength-enhancing ribbing structure 60, 61 and 62, five support posts 50, 51, 52, 53 and 54 which have cylindrical pegs 55, 56, 57, 58 and 59, respectively, extending therefrom, and the slit 41 (and its connecting, circular stress-distributing inner end 42 which defines the hole 48).

FIG. 3 is a sectional view taken along the line 3—3 of FIG. 1, and although it does not show the removable, adjustable, foot-supporting and foot-positioning, orthopedic insert 40 positioned at or near the floor of the ski boot 10, it shows the platform structure at the floor of the ski boot 10 upon which the insert 40 is positioned and retained. FIG. 5 is an enlarged, fragmentary, sectional view taken along the line 5—5 of FIG. 3, and shows the removable, flexible liner member 30 and the removable, adjustable, foot-supporting and foot-adjusting, orthopedic insert 40 operationally positioned and retained at the floor of the ski boot 10. The pegs 55, 56, 57, 58 and 59 extending from the ends of the support posts 50, 51, 52, 53 and 54, respectively, shown in FIGS. 4 and 5, do not have removable, annular or washer-like spacers selectively positioned at or on the ends of the pegs so as to selectively or adjustably position or raise or lower portions of the insert 40 relative to the floor of the ski boot. FIG. 6, is similar to FIG. 5, but shows, when viewed with FIGS. 3, 4 and 5, annular spacers 90, 91 and 92 selectively inserted onto and retained by the pegs 56, 58 and 59 depending from support posts 51, 53 and 54, respectively, so as to selectively support and position the insert 40 and foot relative to the floor of the ski boot 10.

Referring to FIGS. 3 and 4, together, structure is shown in FIG. 3 for receiving, supporting, positioning and retaining the insert 40 shown in FIGS. 2 and 4. More particularly, the holes 75 and 76 in the bosses 70 and 71, respectively, at the floor of boot shown in FIG. 3, are constructed to receive the pegs 55 and 56, respectively, which project from the support posts 50 and 51, respectively, shown in FIG. 4. The slot 78 leading to the connecting hole 77 of the boss 72 shown in FIG. 3 receives the peg 57 which extends from the support post 52 shown in FIG. 4. Furthermore, the slots 80 and 82 leading to the connecting holes 79 and 81, respectively of the bosses 73 and 74, respectively, receive the pegs 58 and 59, respectively, which project from the support posts 53 and 54, respectively, shown in FIG. 4. Referring to FIG. 3, the slotted bosses 72, 73 and 74 provide means for one to slide the pegs 57, 58 and 59, respectively, of support posts 52, 53 and 54, respectively, into the entrance of the slots 78, 80 and 82, respectively, and move those pegs forwardly into the connecting holes 77, 79 and 81 of those bosses, thereby forwardly positioning the insert securely into place in the bosses at the floor of the ski boot.

The insert 40 may, if desired, be readily removed from the insert-supporting structure and the boot.

The slot 78 connecting with the hole 77 of the boss 72, and the slot 80 connecting with the hole 79 of the boss 73, and the slot 82 connecting with the hole 81 of the boss 74 should each have a depth about equal to depth of their respective connecting holes.

The cylindrical pegs may project or depend from the support posts a distance, for example, of about ¼ inch.

FIG. 5 shows the flexible liner member 30 positioned in the shell 20 of the ski boot 10 and supported, in part, by the insert 40.

Referring to FIG. 6, the spacer elements 90, 91 and 92 are shown retained in place between the supporting post 51 and boss 71, the supporting post 53 and boss 73, and the supporting post 54 and boss 74, respectively. If desired, a selected number of annular, washer-like spacers may be placed onto one or more of the depending cylindrical pegs projecting from the supporting posts, by placing the pegs through the circular or annular openings of the spacers. The spacers may be made of plastic, rigid or flexible material and may have varied shapes and thicknesses. One or more spacer elements may be placed on any one or more pegs, or one may elect not to use any spacer on a particular peg.

The foregoing detailed description has been given for clearness of understanding only, and the forms of the invention shown and described therein are to be considered only as illustrative, and no unnecessary limitations should be understood therefrom, as modifications will be obvious to those skilled in the art without departure from the spirit of the invention or the scope of the appended claims, which follow.

I claim:

1. In athletic footwear, the improvement comprising providing in combination with said footwear along desired portions at or near the floor thereof, a removable, adjustable, foot-supporting and foot-positioning, contoured, orthopedic insert for selectively, adjustably, and correctly supporting and positioning bottom regions of the foot, including, but not limited to, the heel and connecting arch region thereof, relative to the floor of the footwear, which, in turn, selectively and correctly supports and positions the leg relative to the footwear, said insert having adjusting means operatively associated therewith for selectively adjusting, varying or controlling its position or distance at a plurality of regions thereof and that of the foot relative to the floor of the footwear, said adjusting means including a respective peg depending from the bottom of said insert at each of said respective regions, and removable spacer members selectively inserted onto and removably retained by a respective peg.

2. The athletic footwear of claim 1, wherein said footwear is an ankle-covering boot.

3. The athletic footwear of claim 1, wherein said footwear is a ski boot.

4. The athletic footwear of claim 1, wherein said footwear is a rear-entry ski boot.

5. The athletic footwear of claim 1, wherein said footwear is a ski boot having an outer shell and an inner liner, and said insert is positioned therebetween.

6. The athletic footwear of claim 1, wherein said insert is in the form of a comfortable, contoured, foot-conforming platform.

7. The athletic footwear of claim 6, wherein said insert has a contoured arch support with a flexure slot transversely extending thereacross to provide flexing of the insert thereat.

8. In athletic footwear, the improvement comprising providing in combination with said footwear along desired portions at or near the floor thereof, a removable, adjustable, foot-supporting and foot-positioning, orthopedic insert in the form of a comfortable, contoured, foot-conforming platform for selectively, adjustably, and correctly supporting and positioning bottom regions of the foot, including, but not limited to, the heel and connecting arch regions thereof, relative to the floor of the footwear, which, in turn, selectively and correctly supports and positions the leg relative to the footwear, said insert having adjusting means operatively associated therewith for selectively adjusting varying or controlling its position or distance at a plurality of regions thereof and that of the foot relative to the floor of the footwear, the floor of the footwear having insert-supporting platform means operatively associated therewith or as a part thereof and to which the insert is operatively and selectively connectable and from which it is removable, a respective peg depending from the bottom of said insert at each of said respective regions, and removable spacer means which may be selectively positioned and retained in place by respective pegs on the insert against the insert-supporting platform means or the floor of the footwear to selectively raise or lower, as desired or needed, relative to the platform means or floor, selected or desired portions of the insert.

9. The athletic footwear of claim 8, wherein said footwear is an ankle-covering boot.

10. The athletic footwear of claim 8, wherein said footwear is a ski boot.

11. The athletic footwear of claim 8, wherein said footwear is a rear-entry ski boot.

12. The athletic footwear of claim 8, wherein said footwear is a ski boot having a substantially rigid outer shell and an inner flexible liner member, and said insert is positioned therebetween.

13. The athletic footwear of claim 8, wherein said insert has a contoured arch support with a flexure slot transversely extending thereacross to provide flexing of the insert thereat.

* * * * *